US008464623B2

(12) United States Patent
Peshkar

(10) Patent No.: US 8,464,623 B2
(45) Date of Patent: Jun. 18, 2013

(54) METHOD AND ARRANGEMENT FOR CONTROLLING THE TEMPERATURE OF TWO CYLINDERS

(75) Inventor: Hossain Peshkar, Malmö (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 703 days.

(21) Appl. No.: 11/991,094

(22) PCT Filed: Dec. 8, 2006

(86) PCT No.: PCT/SE2006/001395

§ 371 (c)(1),
(2), (4) Date: Feb. 27, 2008

(87) PCT Pub. No.: WO2007/089181

PCT Pub. Date: Aug. 9, 2007

(65) Prior Publication Data

US 2009/0264268 A1 Oct. 22, 2009

(30) Foreign Application Priority Data

Jan. 31, 2006 (SE) ..... 0600216

(51) Int. Cl.
*B26D 7/10* (2006.01)

(52) U.S. Cl.
USPC ..... 83/879; 83/72; 83/171

(58) Field of Classification Search
USPC ..... 83/171, 879, 72, 170; 492/46, 45, 492/9; 156/359, 378, 583.1, 583.4, 351, 499, 156/555, 582; 162/194, 286
See application file for complete search history.

(56) References Cited

U.S. PATENT DOCUMENTS

| | | | | | |
|---|---|---|---|---|---|
| 1,302,831 | A | * | 5/1919 | Naugler | 493/396 |
| 2,748,863 | A | * | 6/1956 | Benton | 83/171 |
| 3,227,854 | A | * | 1/1966 | Ramsey et al. | 219/244 |
| 3,314,339 | A | * | 4/1967 | Guffy et al. | 493/403 |
| 3,718,059 | A | * | 2/1973 | Clayton | 83/867 |
| 3,925,127 | A | | 12/1975 | Yoshioka | |
| 3,977,310 | A | * | 8/1976 | Keck et al. | 493/335 |
| 3,981,213 | A | * | 9/1976 | Lopman | 83/346 |
| 4,233,011 | A | * | 11/1980 | Bolender et al. | 425/143 |
| 4,417,883 | A | * | 11/1983 | Granger et al. | 493/403 |
| 4,757,582 | A | * | 7/1988 | Verkasalo | 492/7 |
| 5,022,295 | A | | 6/1991 | Stemmler | |
| 5,045,045 | A | * | 9/1991 | Davenport et al. | 493/363 |

(Continued)

FOREIGN PATENT DOCUMENTS

| | | | |
|---|---|---|---|
| EP | 0515299 | A1 * | 5/1992 |
| WO | WO 00/73029 | A1 | 12/2000 |

OTHER PUBLICATIONS

International Search Report (PCT/ISA/210), Mar. 27, 2007.

(Continued)

*Primary Examiner* — Sean Michalski
(74) *Attorney, Agent, or Firm* — Buchanan Ingersoll & Rooney PC

(57) ABSTRACT

Method and arrangement for controlling the temperature of two cylinders forming a nip. The temperature of at least one point on each cylinder is sensed by sensors, forming a point of measuring, wherein the highest sensed temperature is used as set point and wherein the cylinders are heated in areas where the sensed temperature is below the set point.

11 Claims, 3 Drawing Sheets

U.S. PATENT DOCUMENTS

| | | | | |
|---|---|---|---|---|
| 5,069,658 | A * | 12/1991 | Dupuy | 493/59 |
| 5,158,525 | A * | 10/1992 | Nikkel | 493/471 |
| 5,232,149 | A * | 8/1993 | Stoll | 229/105 |
| 5,268,138 | A * | 12/1993 | Fetterhoff et al. | 264/284 |
| 5,289,766 | A * | 3/1994 | Conrad et al. | 100/329 |
| 5,393,290 | A * | 2/1995 | Lehmann et al. | 492/16 |
| 5,480,509 | A * | 1/1996 | Matsuo et al. | 156/522 |
| 5,529,563 | A * | 6/1996 | Veith et al. | 493/395 |
| 5,639,339 | A * | 6/1997 | Couillard | 156/555 |
| 5,749,990 | A * | 5/1998 | Rello et al. | 156/187 |
| RE36,198 | E * | 4/1999 | Couillard et al. | 156/324 |
| 5,933,988 | A * | 8/1999 | Adler | 38/44 |
| 5,974,921 | A | 11/1999 | Ichikawa et al. | |
| 6,032,712 | A | 3/2000 | Biagiotti | |
| 6,213,183 | B1 * | 4/2001 | Kerr et al. | 156/358 |
| 6,223,799 | B1 * | 5/2001 | Johnstone | 156/542 |
| 6,261,487 | B1 * | 7/2001 | Bongaerts et al. | 264/40.5 |
| 6,435,247 | B1 * | 8/2002 | Kerr | 156/555 |
| 6,544,386 | B1 | 4/2003 | Krzysik et al. | |
| 6,572,519 | B1 * | 6/2003 | Harris | 493/395 |
| 6,688,198 | B2 * | 2/2004 | Matsumoto et al. | 83/139 |
| 6,799,003 | B2 * | 9/2004 | Kishimoto et al. | 399/69 |
| 7,225,688 | B2 * | 6/2007 | Moore et al. | 73/862.55 |
| 7,563,343 | B2 * | 7/2009 | Teshirogi et al. | 156/308.2 |
| 7,670,275 | B2 * | 3/2010 | Schaack | 493/403 |
| 2002/0141794 | A1 * | 10/2002 | Hirst et al. | 399/328 |
| 2007/0059069 | A1 * | 3/2007 | Ishizuka | 399/381 |
| 2007/0095820 | A1 * | 5/2007 | Kinouchi et al. | 219/619 |
| 2008/0287276 | A1 * | 11/2008 | Schaack | 493/396 |
| 2010/0152011 | A1 * | 6/2010 | Schaack | 493/403 |

OTHER PUBLICATIONS

Search Opinion and Supplementary Search Report issued by European Patent Office on May 1, 2012 in corresponding European Patent Application No. 1 981 702.

* cited by examiner

| |
|---|
| Cylinders |
| Plural sensors positioned adjacent each cylinder |
| Shields between the plural sensors and plural heaters |
| Plural heaters |
| Cooling means for cooling each cylinder |

Fig. 5

METHOD AND ARRANGEMENT FOR CONTROLLING THE TEMPERATURE OF TWO CYLINDERS

TECHNICAL FIELD

The present invention concerns a system and a method of controlling and balancing the temperature of two cooperating cylinders forming a nip.

PRIOR ART

In many circumstances where two cylinders form a nip it is most important that the distance between the cylinders are kept within a certain range. Often it is also important that cooperating parts of the cylinders are kept in line with each other.

For many types of cylinders such as scoring cylinders forming a nip it is important that they are properly aligned in relation to each other. In machines for forming containers from a web of a paper or laminate material, there are normally scoring cylinders at some stage. Scores are formed in the web, to assist in the folding of the packages. One of the scoring cylinders has projections that are to go into interacting grooves of the other cylinder. Not properly aligned scoring cylinders may lead to cuts in the web to be scored. When cylinders are heated they will expand. If scoring cylinders are unevenly heated they will expand unevenly which may lead to that cooperating parts of the cylinders does not align properly. Thus, the projection of one cylinder may hit the sides of the grooves of the other cylinder, which probably will cut the web.

SUMMARY OF THE INVENTION

In view of the above one object of the present invention is to eliminate or at least reduce the risk of cutting of a web at a scoring unit due to uneven heating.

One aspect of the present invention is to control the temperature of the two cylinders forming the nip. According to the invention the temperature of the cylinders including bearings and drive are measured continuously in a number of separate points. The algorithm for the temperature control is based on the highest registered temperature, which temperature will form the set point. The other parts of the cylinders, bearings and drive are then heated to the registered highest temperature, i.e. the set point.

In another aspect of the present invention the temperature at different parts of the cylinders, bearings and drive are still registered. Heaters are still provided for heating of the different parts of the cylinders. However, according to this aspect of the present invention the cylinders are placed displaceable at the ends in relation to each other. Either only one or both cylinders are displaceable. The cylinder or cylinders are displaced based on the sensed temperatures.

By means of the present invention the temperature of the cylinders are evenly distributed. Without a control system such as according to the present invention there may be a relatively large difference between the highest and the lowest temperature of the cylinders of the nip.

Even though the present invention is normally described in connection with scoring cylinders at machines for forming containers, a person skilled in the art realises that the principles of the present invention may be used for other cylinders forming a nip.

The control cycle of the present invention is developed for webs having a thickness of at least 150 μm.

BRIEF DESCRIPTION OF THE DRAWINGS

The invention will be described further below by way of examples and with reference to the enclosed Figs. In the Figs.

DETAILED DESCRIPTION OF PREFERRED EMBODIMENTS

Figure 1:
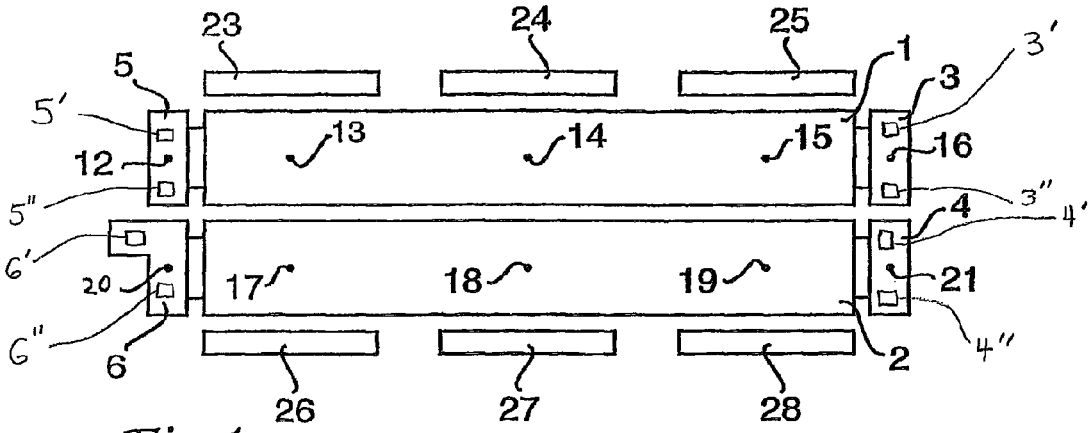
FIG. 1 is a schematic side view of two scoring cylinders incorporating the present invention.
Figure 2:
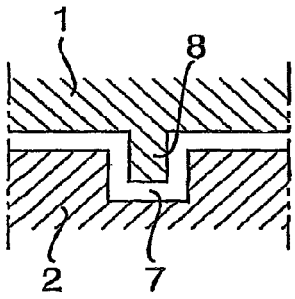
FIG. 2 is a detailed view of a part of a nip of the scoring cylinders of FIG. 1.

In FIG. 1 two scoring cylinders 1, 2 are shown, as one example. Each end of the cylinders 1, 2 is received in a bearing housing 3, 4, 5, 6. One of the bearing housings 6 includes a drive unit.

One of the scoring cylinders 1 has projections 8 formed on the surface of the cylinder 1. The projections 8 are to be received in grooves 7 of the other scoring cylinder 2. If the cylinders 1, 2 are unevenly heated they will expand in various degrees. If the projection 8 of one scoring cylinder 1 due to such uneven heating gets too close to the groove 7 of the other cylinder 2, the web to be scored may be cut in the contact between projection 8 and groove 7.

Figure 3:
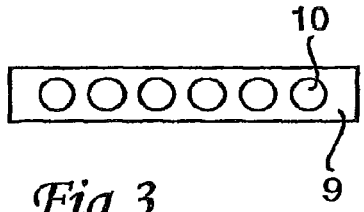
FIG. 3 is one example of a heater assembly that may be used with the present invention.

Heaters 23-28 are arranged along each cylinder 1, 2. Normally at least three heaters 23-28 are arranged for each cylinder 1, 2, one at each end and one in the middle. A person skilled in the art realises that the exact number of heaters are decided in each case depending on the dimensions of the cylinders, the demands on sensitivity etc. In FIG. 3 one example of a heater is shown as a support 9 having a number of IR-carbon light heaters 10. In this embodiment heaters may be placed also inside the bearing housings 3-6 (such heaters being schematically represented by 3'-6' in FIG. 1), which heaters may be air heaters. In other embodiments there are no heaters in the bearing housings 3-6 as the drive unit and bearings normally generates much of the heat during use. The bearing housings 3-6 include oil that assists in distributing the generated heat inside the bearing housings 3-6.

A sensor 11 is associated with at least each heater 23-28 (several of such sensors being schematically shown in FIG. 5), but further sensors may be arranged. The sensors 11 measure the temperature at specific points 12-21 on the cylinders or parts associated with the cylinders. The sensors 11 are normally IR-sensors, but any suitable type of sensor may be used. Temperature sensors can be located in the bearing housings 3-6 as schematically identified by 3"-6" in FIG. 1.

In use one IR-sensor 11 is directed against points of measuring 13-15, 17-19 on the cylinders 1, 2. The IR-sensors measure without contact. In the bearing housings 3-6 other types of temperature gauges may be used, such as a strain gauge. In each bearing housing 3-6 a point of measuring 12, 16, 20, 21 is established. The points of measuring 12-21 are indicated in FIG. 1. In the example shown in FIG. 1 there are six heater assemblies 23-28, one at each end and one in the middle of each cylinder 1, 2. Each of the six heaters 23-28 is associated with a respective point of measuring 13-15, 17-19. A person skilled in the art realises that many different types of sensors and heater assemblies may be used.

Figure 4:
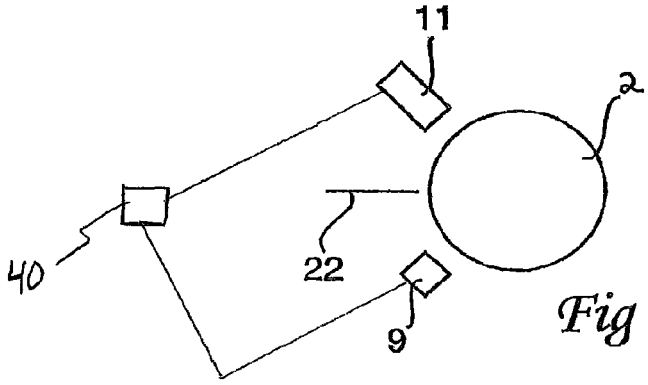
FIG. 4 is a schematic end view of one of the cylinders of FIG. 1, FIG. 5 schematically illustrates cylinders with plural sensors and plural heaters, and cooling means and shields.

To reduce the risk of the heaters 23-28 influencing the sensors 11, one or several shields 22 may be placed between the heaters and the sensors along each cylinder 1, 2, as indicated in FIG. 4. The shields 22 will extend away from the cylinders 1, 2. FIG. 5 schematically illustrates several shields between the heaters and sensors.

The control system of the present invention is based on the highest sensed temperature. Said highest sensed temperature will be used as set point for the other points of measuring 12-21. Thus, if the sensed temperature of a specific measuring point is below the hottest sensed measuring point, the heater associated with that measuring point is activated. If the difference to the highest sensed temperature is above a predetermined value, the associated heater will be run at full effect. When the difference is below said predetermined value the heater will be run at less than 100% and will normally be controlled in such a way that the temperature of the specific measuring point will approach the established set point without exceeding it.

As long as the temperatures of the points of measuring 12-21 are within a certain interval the cylinders 1, 2 will expand relatively evenly, which means that the risk of cutting of the web to be scored is reduced dramatically. A person skilled in the art realises that the temperature interval and the maximal allowed temperature difference between specific points of measuring 12-21 will depend on a number of factors, such as the dimensions of the cylinders 1, 2, the dimensions of the cooperating projections 8 and groove 7 in the forming of the scores, the quality and material of the web, the speed of the web.

In one example the heaters 23-28 are run at full effect if the sensed difference between a specific point of measuring 12-21 and the set point exceeds 2° C. When the difference is below 2° C. the specific heater 23-28 is controlled to let the temperature approach the set temperature without exceeding it. If the temperature in one specific point exceeds the set temperature, that higher temperature will be the new set temperature, if it still exceeds the former set temperature after a predetermined time interval. In one example this time interval was set to 8 minutes.

Figure 6:
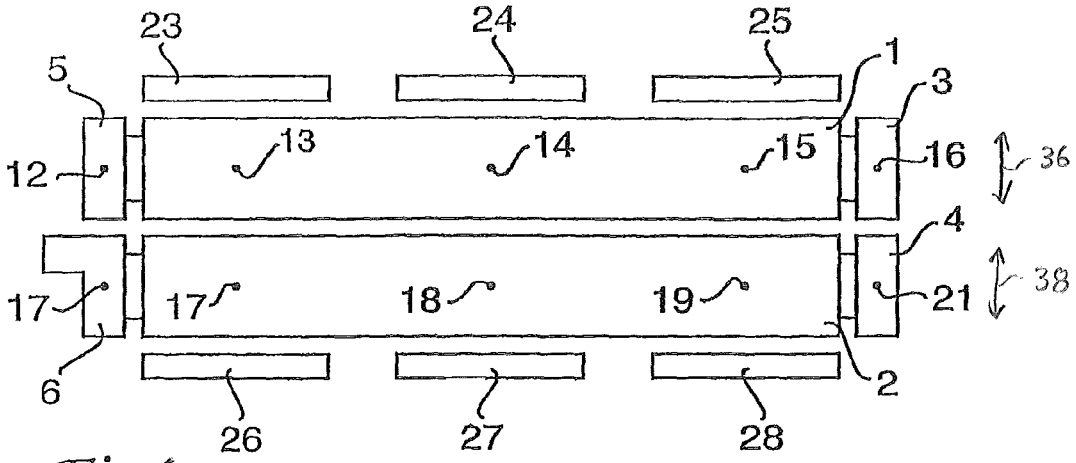
FIG. 6 is a schematic side view similar to FIG. 1, schematically illustrating movement of one or both of the cylinders.

In one other embodiment the distances between the ends of the cylinders 1, 2 may be altered. This is done in that either only one of the cylinders 1, 2 or both cylinders 1, 2 are arranged moveable (schematically identified by arrows 36, 38 in FIG. 6), in relation to each other in such a way that there mutual distance is varied. Normally only one of the cylinders 1, 2 is arranged moveable. In this embodiment there are no heaters in the bearing housings 3-6, but there are heaters along the cylinders 1, 2 in the same way as described above. Also in this embodiment the highest sensed temperature is the set temperature for the rest of the points of measuring 12-21.

The sensors 11, heaters 23-28 and possible actuators to move one or both cylinders 1, 2 are connected to a controller, such as a computer or a CPU (schematically identified as 40 in FIG. 4). The controller will hold the algorithm by which the heaters 23-28 and possible actuators are controlled, based on the temperatures sensed by the sensors 11.

In some embodiments fans, vortex tubes or other cooling means (schematically shown in FIG. 5) are placed together with the heaters 23-28, in which case the temperature control may be done by a combination of heating and cooling or only by cooling. Often the cooling means are only placed at end shafts of the cylinders 1, 2.

The temperature range and the time interval are determined based on the dimensions of the cylinders 1, 2 and the scoring parts 7, 8 of the cylinders 1, 2, on the expected temperature of the cylinders 1, 2 and on the quality and dimensions of the web to be scored.

The invention claimed is:

1. An arrangement configured to score a web of paper or laminated material comprising:

two cylinders positioned relative to one another to form a nip between the two cylinders to receive the web of paper or laminated material;

a plurality of sensors positioned adjacent one of the cylinders to measure the temperature at specific points of measuring on the one cylinder or parts associated with the one cylinder and provide output indicating the temperature at the specific points of measuring on the one cylinder;

a plurality of heaters, each heater being associated with a different one of the points of measuring to apply heat to an area around the point of measuring of the cylinder based on the output from the sensors;

one of the cylinders including at least one projection positioned in a groove formed in an outer surface of the other cylinder to score the web of paper or laminated material in the nip; and a controller configured to control operation of the plurality of heaters, based on the output from the plurality of sensors indicating the temperature at the specific points, so that the temperature at each of the specific points of the cylinder is the same to avoid uneven heating of the one cylinder and allow the web of paper or laminated material to be scored by cooperation of the projection and the groove without cutting the web of paper or laminated material.

2. The arrangement of claim 1, wherein the plurality of sensors is a first plurality of sensors and the plurality of heaters is a first plurality of heaters, further comprising a second plurality of sensors positioned adjacent the other cylinder forming the nip to measure the temperature at specific points of measuring on the other cylinder and provide output indicating the temperature at the specific points of measuring on the other cylinder, and a second plurality of heaters each associated with a different one of the points of measuring on the second cylinder to apply heat to an area around the point of measuring of the second cylinder based on the output from the second plurality of sensors.

3. The arrangement of claim 2, wherein the sensors are IR-sensors and wherein the heaters each include a number of IR-carbon light heaters on a support.

4. The arrangement of claim 3, wherein a shield is placed between each sensor and the associated heater, each shield extends radially from the cylinder.

5. The arrangement of claim 2, wherein temperature sensors are in bearing housings of the cylinders and wherein air heaters are in the bearing housings.

6. The arrangement of claim 1, wherein at least one cylinder of the nip is movable in relation to the other cylinder.

7. The arrangement of claim 6, wherein the sensors and the heaters are connected to a controller and wherein the controller is a computer or CPU containing a control algorithm.

8. The arrangement of claim 1, wherein cooling means are arranged at each of the cylinders to cool each cylinder.

9. An arrangement configured to score a web of paper or laminated material comprising:

two cylinders positioned relative to one another to form a nip between the two cylinders to receive the web of paper or laminated material;

a plurality of sensors positioned adjacent one of the cylinders to measure the temperature at specific points of measuring on the one cylinder or parts associated with the one cylinder and provide output indicating the temperature at the specific points of measuring on the one cylinder;

a plurality of heaters longitudinally spaced apart along the one cylinder, each heater being associated with a different one of the points of measuring to apply heat to an area around the point of measuring of the one cylinder based on the output from the sensors;

one of the cylinders including at least one projection positioned in a groove formed in an outer surface of the other cylinder to score the web of paper or laminated material in the nip; and a controller configured to control operation of the plurality of heaters, based on the output from the plurality of sensors indicating the temperature at the specific points, so that the temperature at each of the specific points on the one cylinder is the same to avoid uneven heating of the one cylinder and allow the web of paper or laminated material to be scored by cooperation of the projection and the groove without cutting the web of paper or laminated material.

10. The arrangement of claim 9, wherein the two cylinders are spaced apart from one another, and each of the plurality of heaters is positioned outside the one cylinder and is positioned in facing relation to an outer periphery of the one cylinder.

11. An arrangement configured to score a web of paper or laminated material comprising:

two cylinders positioned relative to one another to form a nip between the two cylinders to receive the web of paper or laminated material;

a plurality of sensors positioned adjacent one of the cylinders to measure the temperature at specific points of measuring on the one cylinder or parts associated with the one cylinder and provide output indicating the temperature at the specific points of measuring on the one cylinder;

a plurality of heaters, each heater being associated with a different one of the points of measuring to apply heat to an area around the point of measuring of the cylinder based on the output from the sensors;

one of the cylinders including at least one projection and an outer surface of the other cylinder including a groove, the at least one projection being positionable in the groove in the outer surface of the other cylinder to score the web of paper or laminated material in the nip; and a controller configured to control operation of the plurality of heaters, based on the output from the plurality of sensors indicating the temperature at the specific points, so that the temperature at each of the specific points of the cylinder is the same to avoid uneven heating of the one cylinder and allow the web of paper or laminated material to be scored by cooperation of the projection and the groove without cutting the web of paper or laminated material.

* * * * *